US006378179B1

(12) United States Patent
Hirsch

(10) Patent No.: US 6,378,179 B1
(45) Date of Patent: Apr. 30, 2002

(54) SYSTEM AND METHOD FOR RECONSTITUTING FIBERS FROM RECYCLABLE WASTE MATERIAL

(76) Inventor: Gary F. Hirsch, 1144 Moore Rd., Woodside, CA (US) 94062

( * ) Notice: Subject to any disclaimer, the term of this patent is extended or adjusted under 35 U.S.C. 154(b) by 0 days.

(21) Appl. No.: 09/755,523

(22) Filed: Jan. 5, 2001

(51) Int. Cl.[7] ..... D04H 1/06

(52) U.S. Cl. ..... 28/103; 28/104; 28/107; 28/100; 28/102; 442/408; 428/903.3; 19/296; 19/107

(58) Field of Search ..... 28/100, 101, 102, 28/103, 104, 105, 107, 109, 112, 116, 165, 166, 167, 171, 299, 143; 19/65 R, 66 R, 107, 161.1, 163, 65 A, 144, 296, 200, 98; 442/408; 428/903.3

(56) References Cited

U.S. PATENT DOCUMENTS 1,889,615 A * 11/1932 Schorsch ..... 19/89
3,765,989 A * 10/1973 Burger ..... 28/102
4,300,267 A * 11/1981 Winch et al. ..... 19/80 R
4,879,170 A * 11/1989 Radwanski et al. ..... 28/104
5,369,861 A * 12/1994 Ball et al. ..... 28/100
5,380,582 A * 1/1995 Neely, Jr. et al. ..... 28/112
5,481,864 A * 1/1996 Wright ..... 19/107
5,623,748 A * 4/1997 Bacchio ..... 28/101
5,671,495 A * 9/1997 Chen ..... 28/100
5,778,492 A * 7/1998 Thiessen et al. ..... 19/107
6,037,282 A * 3/2000 Milding et al. ..... 442/408
6,061,876 A * 5/2000 Rowe ..... 19/98

* cited by examiner

*Primary Examiner*—Amy B. Vanatta
(74) *Attorney, Agent, or Firm*—Michael Hetherington; Woodside Intellectual Property Law Group

(57) ABSTRACT

A system is provided for structurally reconstituting fibers from recycled waste fabric material, including cotton denim waste, wherein the reconstituted fibers are incorporated into a hydroentangled or needle punched product without binders or additives. A tearing line includes the application of steam and enzymes at a rate sufficient to remove surface additives from the fibers. The process completely opens the fibers and eliminates fraying, twisting and nonconformities. A fiber finishing process provides fibers which are substantially uniform with respect to a desired characteristic such as length, weight, type, or a desired blend thereof. The finishing process also provides a fiber web characterized by a uniform directional orientation of fibers, making the fibers more amenable to hydroentanglement. The resulting nonwoven product is characterized by high strength, fiber integrity and high uniformity and can be cross lapped to thereby provide greatly increased strength and absorbency.

5 Claims, 5 Drawing Sheets

SYSTEM AND METHOD FOR RECONSTITUTING FIBERS FROM RECYCLABLE WASTE MATERIAL

BACKGROUND

The field of the invention relates generally to methods for recycling fibers. In particular, the field of the invention relates to a system and method for providing structurally reconstituted fibers from surplus fabric material such as cotton denim, wherein the fibers are opened, cleaned and structurally engineered for delivery to a card without defects such as fiber bundles (neps) or unopened threads. The reconstituted fibers are then used without binders to produce a finished nonwoven material having structural properties enabling it to be cross lapped and laminated, and exhibiting greater uniformity, strength, and higher absorption characteristics than was previously possible.

Increasing expenses associated with obtaining raw materials and constantly increasing consumption of textile products provide a strong economic incentive for developing methods for recycling surplus or unused textile material which would otherwise go to waste to be burned or buried. Large amounts of cloth scrap, clippings, and loose sample scraps are created at "cut and sew" plants where garments are manufactured. These scraps are waste material that comprise approximately 15–30% of all types of fabric manufactured for use in garments. Unless recycled into insulating materials or nonwoven matting, these cloth scraps and clippings become waste and are sent to landfills. Presently over 200 million pounds of cotton denim scrap material are burned or buried in landfills annually. Such reclaimed fibers are of importance in providing a foundational material for nonwoven fabric technologies that can be designed to replace traditional woven textiles.

In the past, surplus or recycled denim material was rejected as a base for producing fibers for a finished nonwoven product. Cotton denim is one of the toughest fabrics produced and is typically woven so tightly that its fibers cannot adequately be opened or regenerated for reuse. Conventional recycling methods cannot open surplus denim fibers sufficiently for reuse in a hydroentangled product. Conventional methods leave so many unopened threads and neps that a web containing such unopened fibers would be unsuitable for hydroentanglement. Conventional processes for opening denim result in fibers which are too short for hydroentanglement. Such fibers could only be used in conjunction with binders for rough material such as carpet underlayment.

New fabric formation techniques and advanced finishing processes are being used to accomplish fiber to fabric manipulation to provide a final product comprising nonwoven material. One method for producing a nonwoven material is accomplished by hydroentangling or spunlacing a fiber web. Conventional methods of fiber processing form the fiber web, which can be dry laid or wet laid after which the fibers are hydroentangled by means of a plurality of fine water jets under high pressure.

Conventional methods of recycling cloth scraps involve the use of high percentages of virgin (non-waste) carrier fibers or non-biodegradable synthetic fibers. Such conventional methods are inefficient and produce low quality yarn and consequently low quality fabrics. When high percentages (typically more than 50%) of virgin fibers are used, raw material costs are substantially higher and the amount of cloth/fibers recycled is low because the resulting yarn/fabric is primarily virgin/fabric.

Also, the yarn/fabric produced usually must be dyed to a required color since the large amount of carrier fibers required dilutes the color of the scrap material being recycled. This problem is of particular importance when recycling denim because it must be over coat dyed with indigo, the only accepted organic natural dye. Because most of the cloth scraps being recycled already have been dyed, it would be desirable to provide a recycling process which is capable of using a high percentage of dyed fibers in the raw material mix. Products derived from such recycled, dyed fibers or yarns would not require any additional dyeing. This advantageously would eliminate the many costs associated with dyeing yarns and fabrics.

Although non-biodegradable synthetic fibers are available, their use implicates serious environmental as well as cost concerns. The synthetic fibers lack the ability to retain dyes as efficiently as natural fibers, and they do not bond well with other fibers because of their slick surfaces. Furthermore, the resulting fabrics do not have the texture, quality, or acceptance level of premium natural fibers.

Therefore, what is needed is a method of recycling natural or synthetic fibers which can be needle punched and/or provided for hydroentanglement to produce a superior finished nonwoven product. What is also needed is a new method to effectively and efficiently recycle cloth scraps into substantially virgin like fibers which can be needle punched and/or hydroentangled to produce a superior fabric and garments using a minimum amount of carrier fibers.

Recycled fibers also can comprise synthetic fibers, plant fibers, regenerated cellulose fibers, pulp fibers or the like. Conventional methods for mechanical recycling of fibers from nonwoven and textile material are well known.

U.S. Pat. No. 5,481,864 describes a conventional process for recycling cloth scraps to produce a yarn from the fibers contained in the cloth. The process includes moistening the cloth scraps and maintaining the moisture conditioning at a level of at least 10 per cent throughout the process. The process of maintaining fibers in a moist state throughout the shredding process has disadvantages. The web of moist fibers weighs more and the fibers tend to progressively agglutinate and clog the cutting pins of the cylinders in the tearing line. This tends to slow the process and makes the machines run hotter. The progressive agglutination of the fibers also reduces the cutting action and prevents fibers from being fully opened.

The inability to open the moisture laden fibers results in a finished nonwoven product which comprises typically weak, soft and bulky yarn. A web of material comprising such unopened fibers does not have uniform density and is not suitable for hydroentanglement, nor for the production of a strong nonwoven material which would be be capable of use for a wide variety of applications.

Conventionally, surplus fibers, particularly cotton, are opened from a bale and cleaned on air carding machines which act to separate the fibers, ideally to a single fiber state. In order to open the fibers, it is necessary to extract at least some of the surface additives such as starches, binders, or other materials which alter the surface properties of the fibers and prevent fibers from being easily opened.

Binders are typically glues or other types of adhesives which cling to fibers and make them unacceptable for reuse in applications requiring fiber sterility. Binders especially need to be removed from recycled fibers in order to enable the fibers to be opened and reused for other applications U.S. Pat. No. 6,037,282 discloses a conventional process for making a nonwoven material by hydroentangling a fiber web. The fibers used for forming the web comprise waste synthetic fibers, plant fibers, regenerated cellulose fibers or pulp fibers. The fibers are developed by mechanically tearing or shredding a waste material into small bits by conventional methods. The fibers are then blown randomly onto screens and air laid. This creates a random orientation of fibers on a web. Such a random orientation of fibers, when applied to hydroentanglement, produces a structurally inferior product characterized by varying thread density, unopened fibers, neps and other unconformities which render the finished hydroentangled product incapable of being cross lapped or laminated, and thus limits useful applications.

A further disadvantage of the process taught by U.S. Pat. No. 6,037,282 is that the tearing action for freeing the fibers also shreds and stretches the fibers along the longitudinal axis, resulting in weakened, frayed and distorted fibers which may end up twisted and difficult to open. U.S. Pat. No. 6,037,282 concedes that the freeing of the fibers is often incomplete and the fibers clump together to form flocks. The flocks in turn produce nonuniformities in the final nonwoven product, resulting in reduced strength. (See U.S. Pat. No. 6,037,282 at col. 2, lines 54–63; "notably lower strength," col. 3, lines 58–62.)

A conventional process such as U.S. Pat. No. 6,037,282 must compensate for reduced strength of the hydroentangled product by adding binders such as polyamide-epichlorohydrin, EVA, latex, or the like. The amount of additive is between 0.1 and 10 percent by weight, preferably between 1 and 5 percent by weight, calculated as part of the weight of the material (Column 3, lines 2–4). However, this puts surface impurities onto the fibers, making them unsuitable for many applications requiring medical sterility or high absorbency. The addition of binders makes the resulting fibers, which are already weakened, even more difficult to open in the event the nonwoven product is to be recycled. Thus, the addition of binders limits the finished nonwoven material to a single use product.

In addition to adding undesirable binders, a conventional process such as in U.S. Pat. No. 6,037,282 also results in so many unopened fibers and threads that the unopened threads cannot be cleaned of trash such as surface impurities, binders, and other additives. Thus, a hydroentangled product made from such a large proportion of unopened fibers is unusable except for limited applications, such as an industrial wiping or drying material.

Therefore, what is needed is a system for reconstituting fibers from waste or surplus materials, wherein the reconstituted fibers can be applied to a hydroentangling process to produce a nonwoven product of superior strength and uniformity, thereby enabling the final product to be used in a wide variety of applications.

What is also needed is a method for opening fibers of recyclable materials and for removing trash, binders, starches, and other surface impurities from the opened fibers. Such a process advantageously would provide structurally stronger, cleaner fibers which would be more amenable to hydroentangling. A nonwoven product embodying such engineered fibers would be characterized by surface uniformity, high strength and would be suitable for a wide variety of household and industrial applications.

What is also needed is a method for recycling a tightly woven fabric such as cotton denim and for fully opening those fibers with minimal distortion and loss of structural integrity due to tearing and shredding the fibers along their longitudinal axis, such that the fibers may be reused in making a hydroentangled product without defects.

In addition, it would be highly desirable to provide a process for engineering or structurally reconstituting reclaimed fibers which would open and remove all surface additives and impurities from the fibers. Thus, a hydroentangled product comprising such fibers could be made without the need for binders and would conform to high standards of medical sterility for medical, cosmetic, and other applications requiring a contamination free product. Such a hydroentangled product, made without binders, also easily could be recycled for other applications, thereby providing a multi use, resource sustainable product.

SUMMARY

In order to achieve the foregoing objectives and other advantages, an aspect of the invention reconstitutes fibers from recycled or waste fabrics, including cotton denim waste, and forms the reconstituted fibers into a hydroentangled product characterized by substantially uniform fiber density, greater tensile strength and preferential fiber orientation. This enables the hydroentangled material to be cross lapped or laminated with other materials for greatly increased strength. For example, hydroentangled materials comprising directionally oriented fibers in accordance with an aspect of the invention can be cross lapped and coated with a polyurethane laminate barrier, which provides an absolute barrier to blood borne pathogens and has widespread benefit in medical applications.

An aspect of the invention provides a means for granulating the fibers and for conveying fibers through a series of cutting screens, such that the fibers are cut substantially across their diameter, thereby minimizing fiber distortion and preserving the structural integrity of the fibers.

Another aspect of the invention applies steam in combination with an enzyme scrubbing process for completely opening fibers of recycled waste material including cotton denim waste. This substantially removes all surface impurities from the opened fibers including starches, adhesives, binders, and other contaminants. This enables a nonwoven product produced from such fibers to meet stringent standards of sterility for medical applications.

In accordance with another aspect of the invention, a carding/equalization process provides a web of fibers for hydroentanglement characterized by unidirectional fiber orientation and uniform fiber density. The resulting hydroentangled product is structurally different from one produced by a conventional hydroentangled fiber web, in that it is characterized by a preferential fiber orientation and can be cross lapped or laminated with other materials.

The foregoing aspects of the invention also eliminate the need for adding binders and adhesives to the recycled fibers in order to provide material strength. Thus, a nonwoven product produced in accordance with the invention is amenable to further recycling, thereby providing a sustainable, multiple use product.

BRIEF DESCRIPTION OF THE DRAWINGS

These and other features, aspects and advantages of the invention will become better understood with regard to the following descriptions, appended claims and accompanying drawings in which:

DETAILED DESCRIPTION

Figure 1:
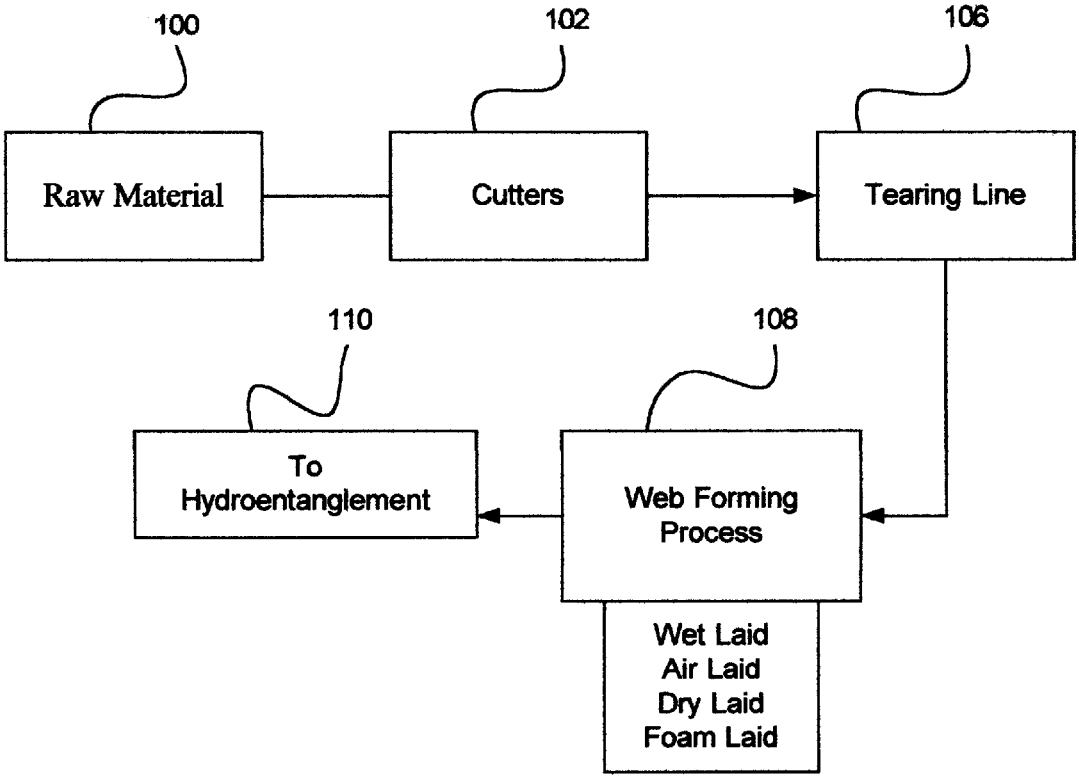
Figure 1 Prior Art
FIG. 1 is a block diagram showing a conventional tearing and carding process prior to hydroentanglement.

FIG. 1 shows a conventional process for recycling fibers and for preparing the fibers for hydroentangling. Raw material 100 comprises recycled waste textiles or unused, surplus scrap material comprising natural or synthetic fibers. Raw material 100 is provided on a conveyor or cutting line to a conventional system of rotary cutters 102. Rotary cutters 102 successively shred the recycled material in a substantially random manner. From rotary cutters 102 the shredded material is conveyed to a conventional tearing line 106 comprising a series of rotary cutters or rotary pins, wherein the fabric is successively torn and shredded. Such a conventional tearing line is incapable of opening woven cotton denim. Woven cotton denim is one of the toughest of fabric materials and is woven so tightly that it cannot be opened sufficiently for reuse in needle punched or hydroentangled product. Thus, a conventional process cannot accept denim scrap for recycling.

Referring again to FIG. 1, the tearing line typically aligns the fibers in parallel along the longitudinal axis of the fiber. Each subsequent tearing step tears and shreds the fibers along the same longitudinal axis causing stretching, fraying, distortion and twisting of the fibers, resulting in general loss of integrity and weakening of the fibers. In addition, twisting of the fibers makes the fibers difficult to open.

Subsequent to the tearing line 106, the torn and separated fibers are conveyed to a web forming process 108 wherein the fibers may be wet laid, air laid, dry laid, or foam laid. In a dry-laid system, the web is formed by having the fibers blown onto a screen in a random manner while in a dry state. With the wet laid system, the web structure is formed by manipulating the fibers while in a wet state. In a foam-laid system, the web structure is formed by blowing thermoplastic fibers onto a collection surface as the fibers are being extruded. In all cases, the web forming fibers are oriented in a substantially random manner.

The resulting web of fibers is then sent to a conventional hydroentanglement process 110. A disadvantage of this conventional process is that the tearing line and web forming process are insufficient to open the fibers that have been delivered from the tearing line. That is, a multitude of unopened, twisted or weakened fibers will be put through the hydroentangling process. This results in a finished nonwoven product which is characterized by surface discontinuities, neps, unopened threads, and a generally unaesthetic appearance. Such a nonwoven product is typically usable for only limited applications such as for industrial wipes or carpet underlayment. In addition, the fibers comprising such a product must be held together by the addition of binders or glues. Basically, this conventional process results in a single use product which again creates more waste after only a single application.

Figure 2:
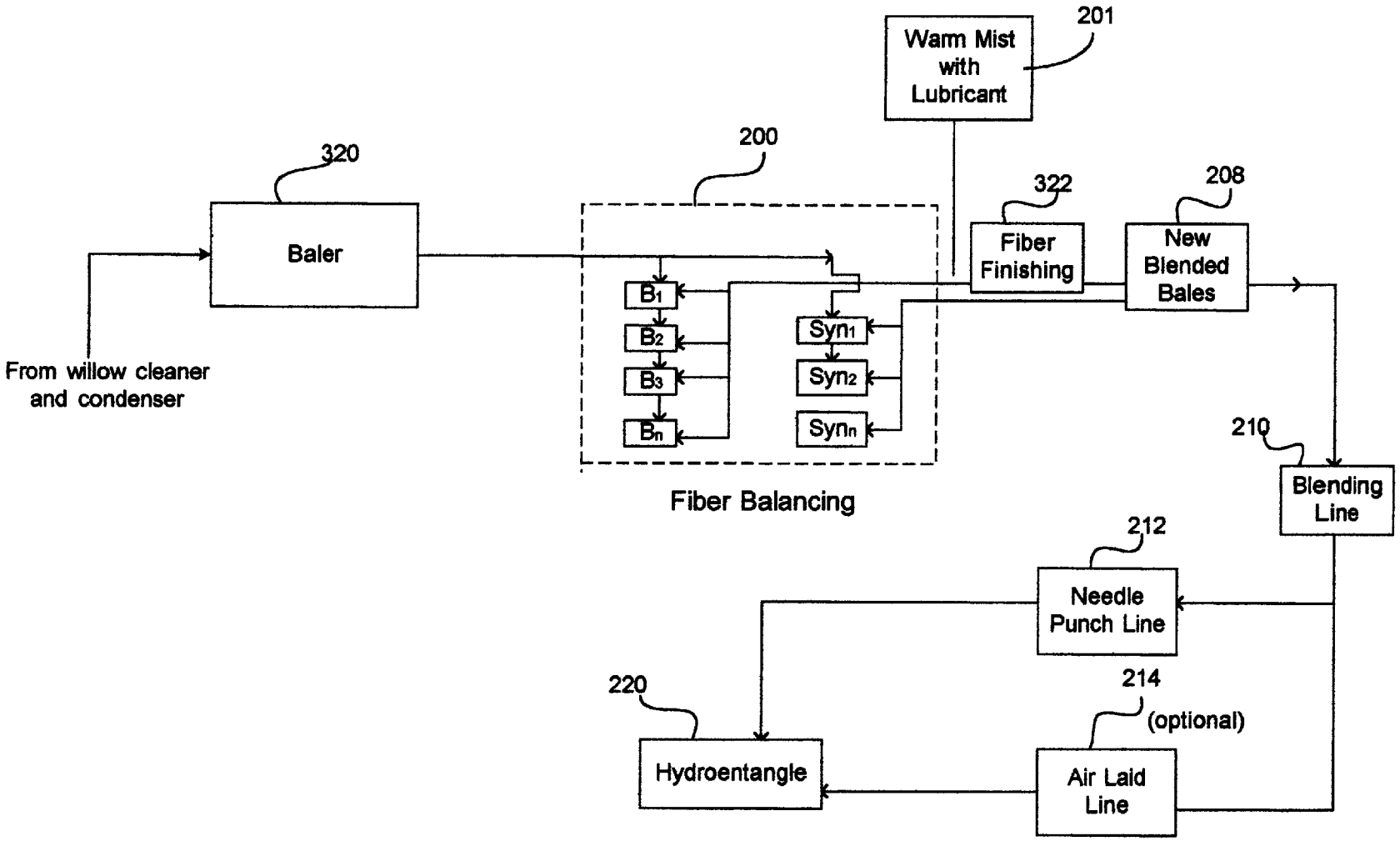
FIG. 2 is a block diagram of a process for engineering fibers and for producing a finished product by hydroentanglement in accordance with an aspect of the present invention.

FIG. 2 shows a fiber balancing process 200 according an aspect of the invention in which waste synthetic or natural fibers derived from raw materials, including cotton denim, are opened and provided in a preferential directional orientation on a web for hydroentanglement.

Figure 3:
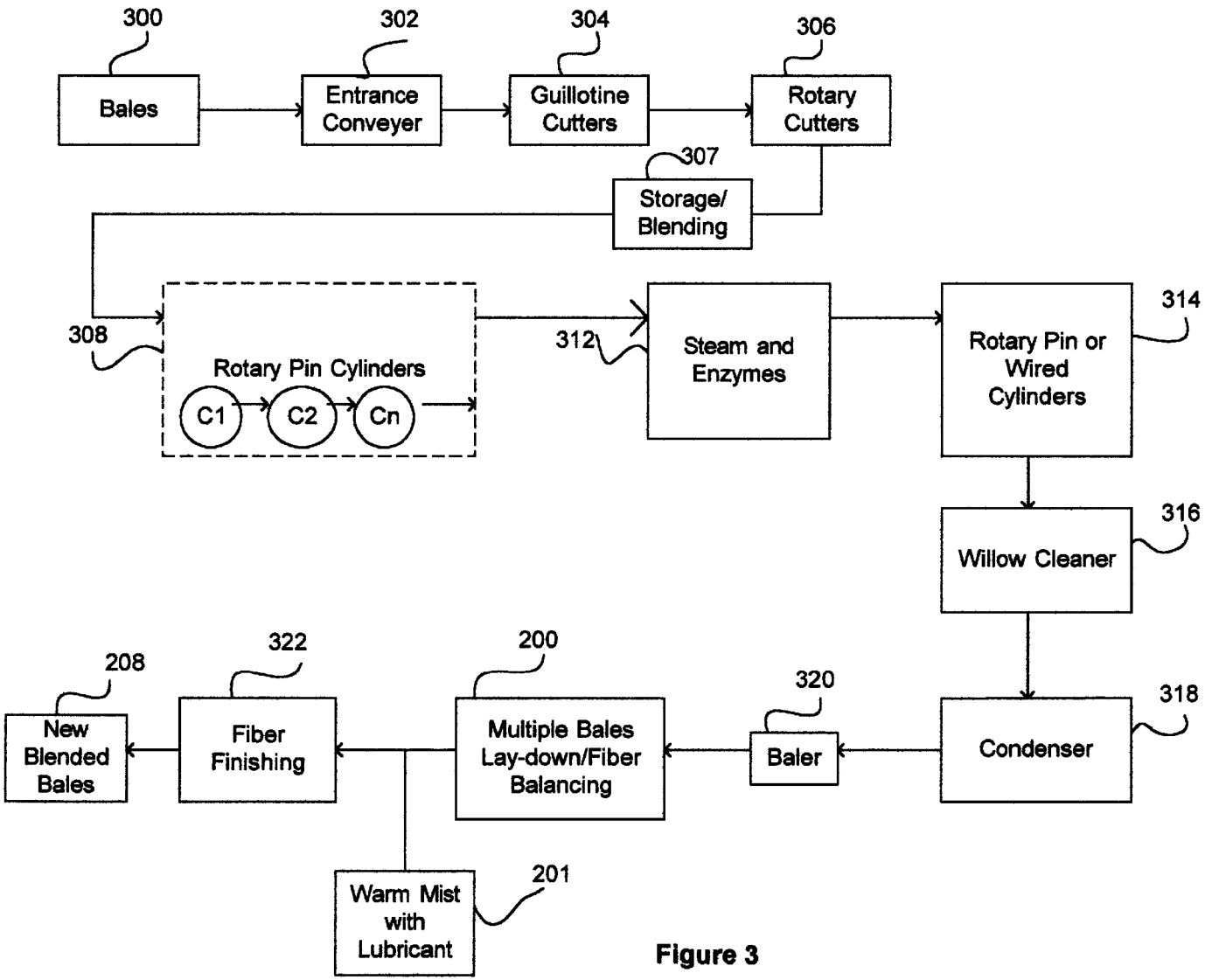
FIG. 3 is a block diagram of an alternative process for engineering fibers and producing a finished product by hydroentanglement in accordance with an aspect of the present invention.

Referring to FIG. 3, opened fibers from a series of rotary pin or wired cylinders 314 are provided to a willow cleaner 316 and condenser 318, respectively. The willow cleaner 316 air lofts and cleans the fibers in accordance with standard techniques. The fibers are then collected in the condenser 318 and condensed into the form of a lap or batting. The condensed fibers are delivered to a conveyor for transporting to baler 320 where fibers are laid down into open bales in a standard manner for further processing.

Referring again to FIG. 2, bales of fibers from baler 320 are provided to a fiber balancing/equalization process 200. Fiber balancing process 200 separates bales of fibers in accordance with known techniques for picking and balancing fibers according to measurable characteristics such as size and weight or by the composition of fiber. In the example shown, natural fibers are output to a plurality of bales B1, B2 . . . Bn. The bales represent successive "runs" or applications of natural fibers through rotary pin or wired cylinders 314 (FIG. 3) or a granulating process (such as 406 in FIG. 4) which cuts the fibers to a predetermined size.

Successive "runs" of synthetic fibers through the granulating process also result in synthetic fibers being sorted into a series of bales, SYN 1, SYN 2 . . . SYN n. Fiber balancing process 200 enables multiple bales of engineered fibers of known lengths and characteristics to be sorted according to known characteristics for subsequent processing and blending.

In accordance with this aspect of the invention, fiber finishing 322 comprises an equalization process which is applied selectively to the plurality of bales in 200. Fiber finishing includes a picker or other means for sequentially removing a layer of fibers from each bale or selected bales B1 . . . Bn or SYN1 . . . SYN n. Alternatively, bales of natural fibers B1 . . . Bn can be balanced in any desired proportion with bales of synthetic fiber SYN 1 . . . SYN n. In addition, layers of fibers can be balanced selectively from each of the bales B1 . . . Bn or SYN 1 . . . SYN n. The thickness of each layer selected can be the same or may be varied in accordance with the needs of the material which is to comprise the final product. The purpose of this process is to ensure uniformity of fiber characteristics such as density or preferential fiber orientation. By picking a layer of fibers from selected bales a web of material is successively built up of layers wherein the resulting fibers are equalized. That is, a web of material can be made uniform because fibers can be sorted by their properties to build in uniformity to an extent which was not previously possible.

In addition, equalized layers from natural fibers, (for example B1, B2) can be matched with other selected layers from synthetic bales SYN 1, SYN 2, . . . SYN n, etc. This also enables fibers of selected lengths and characteristics to be blended with a high degree of uniformity in the resulting hydroentangled material.

After blending of fibers at 200, blended fibers are conveyed through a station 201 which applies a warm mist comprising a glycerine based lubricant to the fibers. The warm mist is at a temperature in a range sufficient to enable the fibers to be expanded, but does not agglutinate the fibers. The mist applies a glycerine based oil to the fibers which softens and untwists the fibers. The adhesion of the glycerin based oil to the fibers also eliminates untwisted fibers, neps and nonconforming fibers in the fiber finishing process at 322. Fiber finishing 322 comprises a series of combing wires. The lubricated fibers from 201 are completely straightened and untwisted by the combing wires in fiber finishing 322 such that the resulting blended bales at 208 are free of any neps and are characterized by uniform density.

According to this aspect of the invention, fiber balancing 200 in combination with fiber finishing 322 makes possible a more uniform distribution of fibers by removing in sequence a predetermined layer from each of a plurality of bales. This also produces at new blended bales station 208 a blending of synthetic and natural fibers of desired lengths and other characteristics such as weight, thickness, color, or the like.

From the fiber finishing 322 and new blended bales 208, the fibers are then provided to a blending line 210. At 210 the finished fibers are formed into a web characterized by their selected uniform characteristics. For example, fibers may be formed onto a web with a preferred uniform directional orientation. The web of directionally oriented fibers is provided selectively to either a needle punch station 212 or to hydroentanglement 220.

In needle punched station 212, the fibers are needle punched in a wide variety of thick nesses in accordance with the characteristics imparted by fiber balancing 200 and fiber finishing 208. Needle punch station 212 also can perform needle bonding wherein a fiber web is bonded into sheets by the action of barbed needles which entangle the fibers. The needle punched fibers from 212 are then conveyed to hydroentanglement station 220 to be hydroentangled into a finished product.

In accordance with an aspect of the invention, the foregoing process results in a web characterized by preferred directional fiber orientation. This provides a hydroentangled product of uniform density and selected directional fiber orientation structurally different from that produced by a conventional web of randomly oriented fibers.

The hydroentangled product made from the web according to this aspect of the invention is substantially uniform in terms of fiber density, has greater tensile strength, and is free of unopened fibers. In addition, the ability to form a web of unidirectionally oriented fibers according to the invention enables the resulting hydroentangled product to be cross lapped to thereby provide greatly increased strength and absorbency.

The crosslapping of directionally oriented fibers also enables the hydroentangled product to be laminated and coated with a polyurethane laminate barrier, for example, which would provide an absolute barrier to blood-borne pathogens. This provides a clear advantage in using such a hydroentangled product for medical applications.

Optionally, the web of material from 210 may be conveyed to an air laid station 214 wherein layers of fibers are progressively laid down and may be cross lapped to impart additional strength. The air laid fibers at 214 have a preferred weight in a range of about 3 oz. up to 7 or 8 oz. per square yard.

FIG. 3 shows an aspect of the invention in which bales of raw material 300 are provided to an entrance conveyor 302. Raw material 300 comprises either natural or synthetic fibers or a blend of both. Aspects of the invention provide for substantially complete opening of the fibers and removal of all surface additives or "trash". Accordingly, fibers can be derived from waste, surplus or recycled materials including woven cotton denim. Thus, raw material 300 may comprise for example, recyclable synthetic material or natural material such as 100% cotton denim waste, linen, wool, or the like.

The following aspects of the invention provide a process for producing reconstituted fibers from the foregoing materials which are substantially opened, cleaned of any surface additives including binders and starches and reengineered to a substantially virgin state. Furthermore, the reconstituted fibers can be long enough (0.8–0.9 inches) so that they can be used in a variety of applications and are delivered to needle punching or hydroentangling substantially without neps, unopened threads, or the like.

From the entrance conveyor 302, bales of raw material are conveyed to guillotine cutters 304. The guillotine cutters 304 cut the raw material to a desired manageable size. The cut raw material is then conveyed to rotary cutters 306. Rotary cutters 306 comprise one or more rotary cutters which further cut the materials and impart an initial desired orientation to the scraps of material.

The scraps of material from the rotary cutters 306 are then conveyed to storage/blending boxes 307 for blending with other scraps. The blended materials in the storage boxes are amenable to chemical treatment or other chemical manipulation, for example the application of sterilizing agents or other agents to remove trash or surface additives from fibers. A conventional pinned inclined apron picks up material from the storage boxes such that the material is then air conveyed or air transferred out of storage/blending boxes 307 to rotary pin cylinders 308. Alternatively, scraps of material from the rotary cutters 306 may be conveyed directly in a web to a first series of rotary pin cylinders 308.

In a preferred embodiment, rotary pin cylinders 308 comprise three or more independently controlled cylinders C1, C2, Cn. Thus the speed of cylinders C1, C2, Cn, can be varied to obtain different cutting results with respect to different types of fabrics. The rotary pin cylinders 308 are provided with a plurality of cutting pins disposed about the circumference of their respective surfaces. The angle of the cutting pins can be varied so that the angle at which the pins strike the fibers can be optimized to increase or decrease the cutting action depending upon the strength and thickness of the fibers and other variables. When the web of material having a preferential orientation is passed over the first rotary pin cylinder C1, the incident angle of the cutting pins with respect to the fibers can be set according to properties desired in the output fibers. The fiber web is then passed sequentially over successive rotary pin cylinders C2, . . . Cn. The incident angle of the cutting pins of each subsequent rotary pin cylinders 308 can be adjusted so that the fibers can be gradually opened without loosing strength or integrity.

The web of opened fibers from rotary pin cylinders 308 is then conveyed to one or more storage boxes 310. Alternatively, the web of fibers may be conveyed directly to an enzyme treatment as described infra. The storage boxes 310 are filled sequentially in layers for blending. Blending of fibers of different weights can be accomplished in the storage boxes by fiber equalization as described in FIG. 2. In accordance with an aspect of the invention, storage boxes 310 facilitate the selective incorporation of an enzyme treatment to the fibers or selected layers of fibers. Steam and enzyme treatment 312 also can incorporate the application of reducing agents to thereby remove chemical impurities, and prepare for subsequent steam removal of surface additives such as starch, binders, or other so-called trash. The progressive opening of the fibers accomplished by rotary pin cylinders 308 enhances chemical manipulation of the fibers.

The opened fibers are conveyed from storage boxes 310 to a steam and enzyme application station 312. Steam at 312 is provided to the fibers through a series of jets which may be disposed above or below a web containing the fibers. The steam has a temperature in a range of about 185 degrees F. to 310 degrees F. What is important is that the steam is applied at a temperature and rate sufficient to cleanse the fibers of additives and bacteria, yet not saturate the web. This prevents agglutination or clumping of fibers and therefore eliminates inconsistencies or density variations in the web. The steam is applied in a manner so as to not over saturate the fibers while at the same time further opening the fibers and removing surface additives such as starch, binders or other trash from the fibers.

The steam-opened and cleaned fibers are then conveyed for the application of enzymes to further remove starch and other surface additives which may not have been taken out by the steam. An enzyme treatment is provided to remove starch and binders from the fibers. Enzymes also may be employed at this point to change the surface properties of the fibers, making them hydrophilic, if desired for a high-absorbency application of the hydroentangled product.

The enzymes are of a type whose catalytic cleansing ability is not affected by the temperature of the steam saturated fibers. The enzymes are typically applied in either a bath or by means of a high pressure wash. The purpose of the enzyme treatment is to remove all of the starches, binders, adhesives or any other surface additives from the material. After the material leaves the enzyme treatment station 312, steam can be applied to the output fibers in order to clean the fibers thoroughly so that they could also be treated with a colorfast chemical at this point. However, these two steps are optional.

Preferably, the treatment may be accomplished utilizing a conventional amylase enzyme which converts starch on the fibers to sugar, which is water soluble and can be washed out of the fibers. Such an enzyme treatment is typically about fifteen minutes long at 140 degrees F. and comprises adding 1–2% enzyme per pound of fiber. An example of an enzyme is RAPIDASE-XL, a conventional amylase enzyme manufactured by International BioSynthetics. Since enzymes are active within an optimal temperature range of about 45° C. to 60° C., the enzyme treatment can be deactivated as is well known by changing the temperature or pH level after the hydrolysis of fibers to the desired extent. Because the enzymes are natural proteins, readily biodegradable, they are a favorable alternative to many finishing chemicals and resins that are currently used.

After the enzyme treatment, the fibers are rinsed, typically for five minutes, or long enough in order to ensure that all starches and other additives are extracted. The enzyme treatment also can employ other commercially available amylase enzymes, penetrants, and wetting agents depending on the desired characteristics to be engineered into the fibers. A blend of amylase enzyme, penetrants and wetting agents, such as Blue-J 421, available from Sybron Tanatex Company, or equivalent, can be used to rapidly decompose sizing agents from fibers and can improve the wetting and absorbent properties of synthetic fibers.

On polyesters, reactions with several lipases can be used to convert the typically hydrophobic surfaces to hydrophilic ones. Such enzyme hydrolyzed polyester fibers are well known and can be chemically engineered in a well known manner to have wetting and absorbent characteristics much superior to the original fibers. The surface nature of these reactions has no effect on the strengths of the materials. With respect to cotton denim, several pectinases, proteases, and lipases have been shown to be effective in removing the pectins, proteins, and fatty acids on fiber surfaces, thereby rendering the fibers hydrophilic.

Thus, the recylced fibers are structurally reconstituted to a substantially virgin state. The fibers are completely opened, sterilized, freed from surface additives, and their surface structure can be enzymatically engineered to achieve a desired degree of absorbency.

The resulting hydroentangled product derived from the engineered fibers according to this aspect of the invention is characterized by superior strength due to the unidirectional properties of the input fibers, exhibits a marked increase in dimensional stability and can be held together without binders. The sterile, binderless fibers also can be cross-lapped such that the hydroentangled product surface structure is characterized by a high hydrophilic state. A hydroentangled product comprising such fibers thus can be provided with specific therapeutic substances for medical applications.

After steam and enzyme treatment 312, the fibers may be transported to rotary pin or wired cylinders 314 for further processing or drying.

At the output end of enzyme station 312, fibers from the bales of raw materials 300 are now reengineered in the sense that they have been opened and all surface additives have been removed. The fibers are then air lofted and conveyed to a second series of rotary pin cylinders 314. Rotary pin cylinders 314 comprise a one or more successive rotary pin cylinders. In a preferred embodiment, three rotary pin cylinders 314 are employed.

The speed of the rotary pin cylinders 314 can be varied to provide additional refinements to the fibers. For example, the speed of the rotary pin cylinders 314 can be optimized to cool the fibers such as cotton. This aids in keeping the cotton fibers at a specific temperature in order to further open the fibers without breaking them. In addition, the angles of the cutting means or pins on the rotary pin cylinders 314 also can be varied to a specific angle which optimizes opening of the fibers without breaking.

It will be appreciated that fibers from the output end of rotary pin cylinders 314 are now reengineered in the sense that they are substantially completely opened and are free of all surface additives. That is, recycled fibers including woven cotton denim have been opened, and reengineered to a substantially virgin state. Unopened fibers are kept to a range of less than 10% and preferably to a range of about 0% to 1%. Such fibers now can be reused in either a needle punched product or can be delivered to hydroentanglement to provide a more uniform hydroentangled product without neps, unopened threads, or other nonconformities.

Fibers from the output end of rotary pin cylinders 314 are provided to willow cleaner 316 where they are cleaned and air lofted in accordance with standard techniques. From willow cleaner 316, the fibers are conveyed into a condenser 318. The condenser 318 removes air from the fiber web thereby enabling the fibers to fall by gravity into boxes to be compressed into bales at 320.

Bales are then provided to fiber balancing station 200. Balanced fibers are then misted with warm glycerine based lubricant at station 201 as explained with reference to FIG. 2; and conveyed for fiber finishing at 322. Fiber finishing creates a preferential, unidirectional orientation of the fibers. The resulting hydroentangled product employing these fibers is characterized by a finish free of twisted yarn and nonconformities. The hydroentangled product made by this process can result in a high-grade material of medical purity for reception of anti-microbial agents for medical and cosmetic applications. In addition, the preferential orientation enables the hydroentangled product to be cross lapped and laminated for superior strength.

Figure 4:
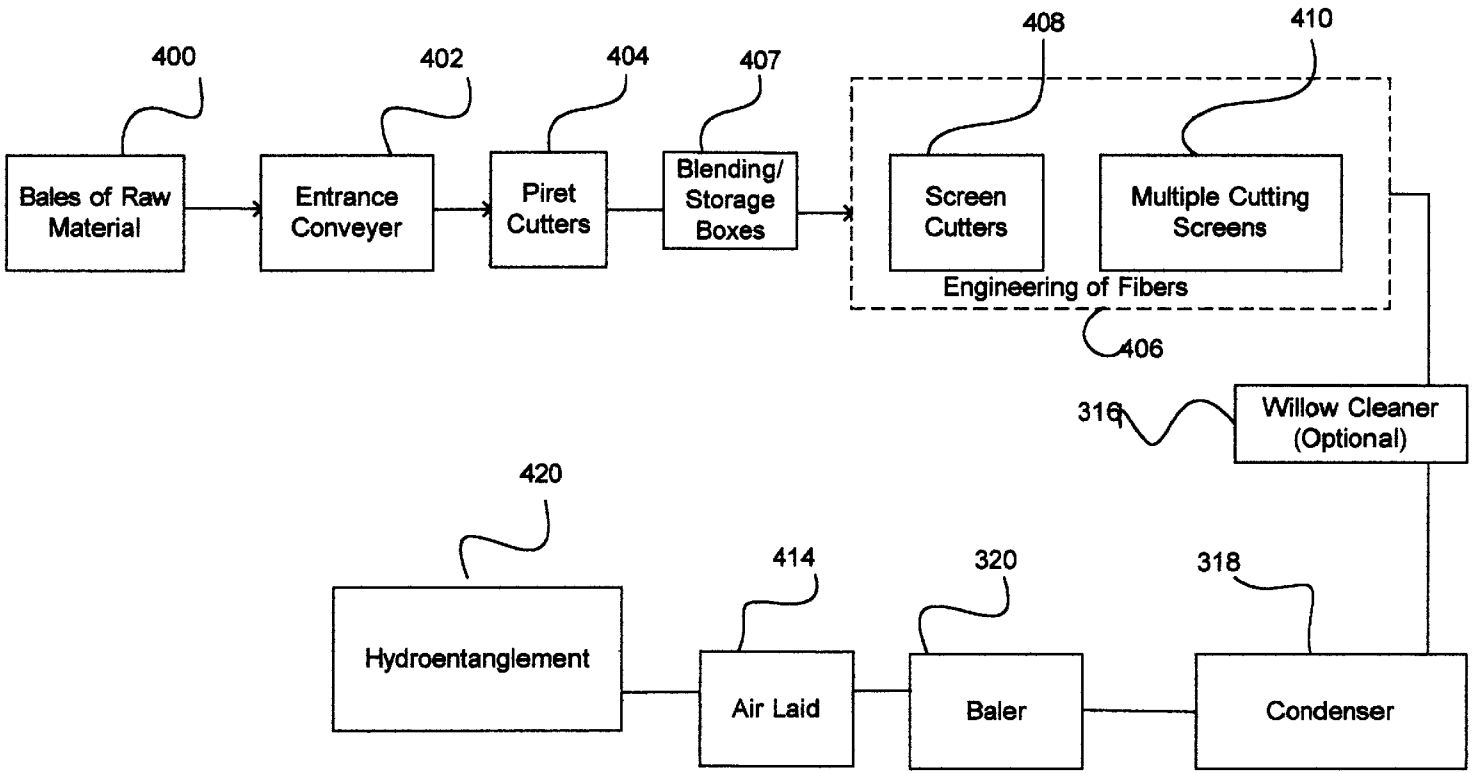
FIG. 4 is a block diagram of another process for engineering fibers and for producing a finished product by hydroentanglement in accordance with an aspect of the present invention.

FIG. 4 shows another embodiment of the present invention for opening fibers from waste or surplus material. In particular, this aspect of the invention also can be used to open fibers from 100% cotton denim. Referring to FIG. 4, bales of cotton denim or other raw material 400 are provided to entrance conveyor 402 and then conveyed to Piret cutters 404.

Piret cutters 404 cut the fabric from the entrance conveyor and perform an initial fiber orientation across the web of fabric. Piret cutters 404 cause the fiber orientation to be in the lengthwise direction parallel to the direction of travel of the web. The fiber orientation can be achieved by preferential placement of the Piret cutters. The Piret cutters influence the elongation properties of the fibers and thereby prepare the fibers for the engineering process 406.

Materials are conveyed from the Piret cutters 404 to storage/blending boxes 407. These have the same function as storage/blending boxes 307 described with reference to FIG. 3. Engineering process 406 comprises a first set of rotary screen cutters 408 which receive the fibers in a preferred orientation from Piret cutters 404. Rotary screen cutters 408 comprise a series of preferably two to four or more serially disposed rotary screen cutters 408 which are arranged to cut the fibers substantially across their diameters, thereby minimizing the fraying, stretching, twisting, distortion and general weakening of the fibers characterized by a conventional tearing process.

In accordance with an aspect of the invention, the engineering process 406 also comprises a series of multiple cutting screens 410 which cut the fibers across their diameters. The purpose of sequential cutting by a series of multiple cutting screens 410 is to create fibers on consistent length and denier quality. The series of multiple cutting screens 410 can selectively cut the fibers to specified lengths as short as 1/32 of an inch. Thus, the engineering process creates fibers of uniform sizes such as, for example: 1/32, 1/16, 1/8, 3/16, 1/4, 3/8, 1/2, or 3/4 inches by successive applications of fibers through each of the granulating or multiple cutting screens 410. Thus, if a shorter fiber is required, multiple screens are used. This results in an engineered fiber characterized by superior structural integrity, wherein neps, twisted fibers and any nonconforming fibers can be eliminated. The engineered fibers are now consistent in length and diameter.

The engineered fibers are then optionally conveyed to willow cleaner 316 which operates as described with reference to FIG. 3. From the willow cleaner 316, fibers are conveyed to condenser 318 and baler 320 which also operate as explained with reference to FIG. 3. The output fibers from baler 320 are then conveyed to an air laid process 414. Air laid process 414 then blows the engineered fibers onto a web. All fibers are consistent in length and diameter. The air laid process 414 results in a web characterized by uniform density and the absence of unopened fibers, twisted fibers, nonconforming fibers, or other nonconformities which would result in neps or unevenness. The web of uniform density is then conveyed to hydroentanglement 420. The resulting hydroentangled product is characterized by uniform density, increased strength and absorbency.

In accordance with an aspect of the invention, the engineering process shown in FIG. 4 enables the fibers to be cut across their diameters. This substantially eliminates unopened threads, twisted and frayed fibers and inconsistent or uneven disbursement of fibers. Thus, the finished hydroentangled product according to the present process is highly uniform in structure and appearance. The consistent disbursement of fibers also increases absorbency and the capacity to retain fluids for subsequent applications without waste, such as hydroentangled pads saturated with fine lubricants.

Figure 5:
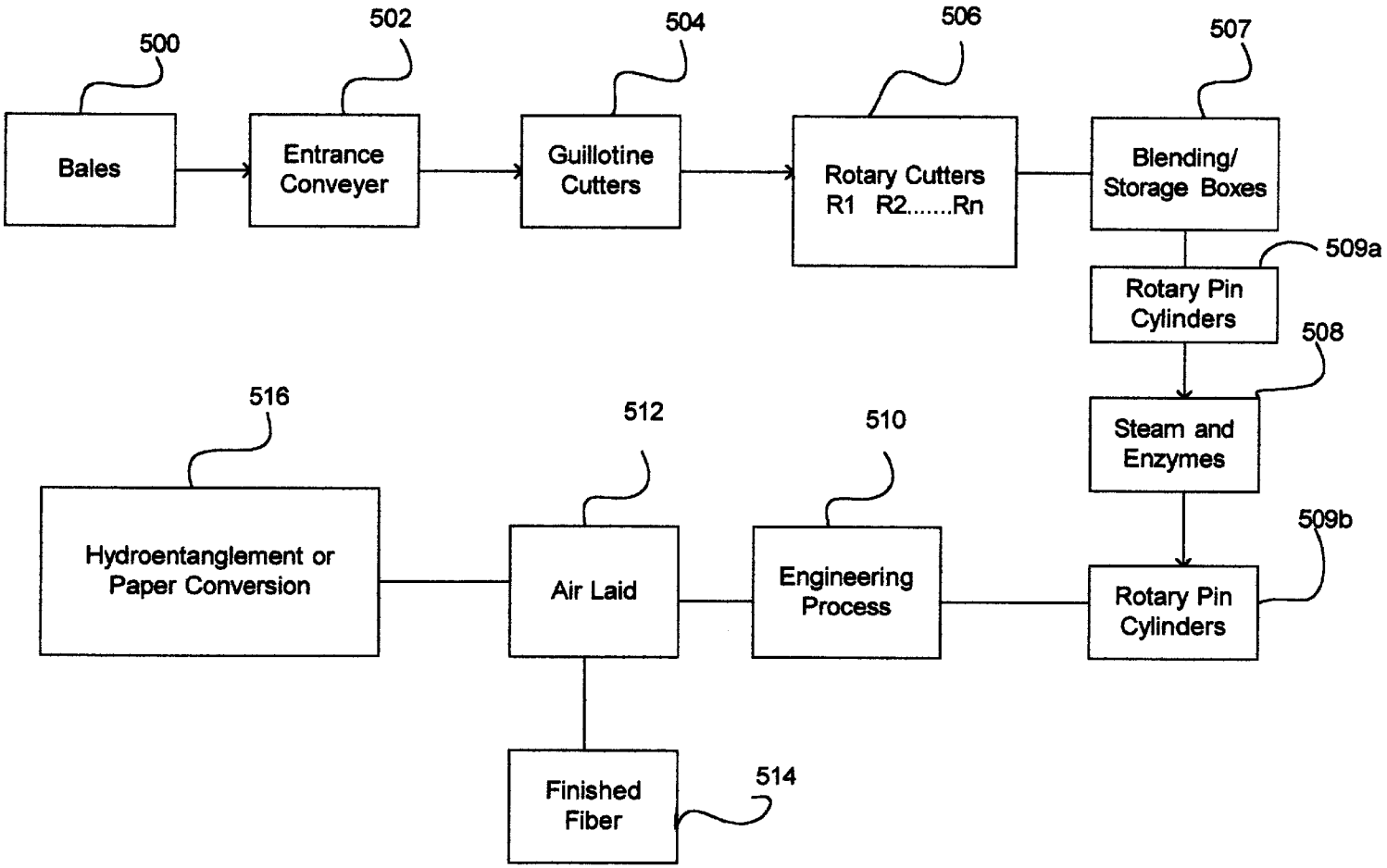
FIG. 5 is a block diagram of another process for engineering fibers for hydroentanglement in accordance with an aspect of the invention.

FIG. 5 shows a process for engineering fibers, including fibers derived from woven cotton denim waste, such that the fibers are reconstituted to a substantially virgin state. Bales of raw material including surplus cotton denim fabric 500 are provided to entrance conveyor 502. The material is then conveyed to guillotine cutters 504. Guillotine cutters 504 cut the bales of fabric in a controlled manner and impart a fiber orientation in the longitudinal direction. The web of cut fibers is then applied to a tearing line comprising a series of rotary cutters 506. Rotary cutters 506 preferably comprise three or more independently controlled rotary cutters, R1, R2, Rn . . . In accordance with an aspect of the invention, the rotary cutters are independently controlled and the speed of each cutter can be optimized to maintain a constant temperature for cotton fibers.

As the fibers are opened by rotary cutters 506, a web is elongated and successive cutters must rotate faster than initial cutters. In accordance with an aspect of the invention, steam may be added anywhere in the tearing line comprising rotary cutters 506. However, it has been found that best results are obtained when steam and enzymes 508 are added after the third or subsequent rotary cutter.

From rotary cutters 506, shredded material is conveyed to blending ans storage boxes 507 for chemical manipulation as explained with reference to storage boxes 307 in FIG. 3. The material is then air conveyed to steam and enzyme application station 508.

Steam and enzymes 508 are added in accordance with the description set forth with reference to FIG. 3, and provide many advantages not previously attainable. For example, the addition of steam in the tearing line has been found to open denim without breaking the fibers. The steam additionally untwists the fibers and adds strength during the subsequent opening of the fibers by the series of rotary cutters. The addition of steam at 508 also has been found to advantageously cool the web of material and the rotary cutters, thereby enabling the entire process to run cooler. This occurs due to the fact that the steam condenses quickly onto the fibers on the moving web. This also adds an additional disinfecting step so that the output fibers are sufficiently clean to meet standards of medical purity.

After the application of steam and enzymes at 508, The web of opened and sterilized fibers is sent to a series of rotary pin cylinders 509 which are used to further refine the lengths of the fibers according to the needs of the final product. It will be appreciated that the fibers from the output of steam and enzyme treatment 508 are substantially opened and have a preferential lengthwise orientation on the fiber web. This is also true for the engineered fibers from the output of the series of rotary pin cylinders 509.

In addition to the cleaning and strengthening action of the steam, the enzyme process at 508 removes all of the surface additives from the fibers. Thus, denim or other fibers exiting the rotary pin cylinders 509 are completely cleaned and opened, and are reconstituted to a state substantially equivalent to virgin fibers. For this reason, the output fibers in accordance with this aspect of the invention are defined herein as engineered fibers.

The cleaned and opened fibers now have a lengthwise orientation on a fiber web. The opened fibers are then conveyed to engineering process 510 comprising a series of multiple cutting screens which create a specified fiber length. The multiple cutting screens are disposed for cutting the lengthwise oriented fibers cut the fibers substantially across their diameters and can create fibers in selected lengths as short as 1/32 of an inch. This eliminates neps, unconformities and twisted fibers. The fibers are then air laid at 512 and conveyed to hydroentanglement or paper conversion 516.

Alternatively, the air laid fibers can be conveyed to finishing cards at finished fiber station 514. The finishing cards align the fibers in substantially uniform, preferential direction or orientation for subsequent hydroentanglement. The carding process at 514 results in a web characterized by uniform density and unidirectional fiber orientation. The hydroentangled product made from the web according to this aspect of the invention is substantially uniform in terms of fiber density, has greater tensile strength, and is free of unopened fibers.

Since the fibers are cleaned of surface additives, disinfected by superheated steam and fully opened, they provide a superior product capable of meeting standards of medical purity. Such fibers can be used for many medical applications and can be used as an applicator base for the superficial application of liquid medication, salves, ointments, or the like.

The finished hydroentangled product, according to this process also has many advantageous cosmetic applications. For example, the hydroentangled finished product produced by the process described herein actually has higher absorbency characteristics than can be achieved by a conventional hydroentanglement process. The substantially complete cleaning ad disinfecting of the opened fibers from the output of tearing line 406 makes the fibers more amenable to hydroentanglement.

Also, since the fibers are finished to attain a preferential orientation on a web, the hydroentangled product made from the web carries over and incorporates a preferential alignment of fibers. This enables the hydroentangled product to be cross lapped and laminated with a barrier film such as polyurethane, to provide an absolute barrier to blood borne pathogens in medical applications. The crosslapping of directionally aligned fibers of a finished hydroentangled product also results in greatly increased absorbency or the capacity to hold and apply medication or cosmetics for a prescribed duration of time.

While the invention has been described in connection with what is presently considered to be the most practical and preferred embodiments, it is to be understood that the invention is not limited to the disclosed embodiments and alternatives as set forth above, but on the contrary is intended to cover various modifications and equivalent arrangements included within the spirit and scope of the appended claims.

For example, one skilled in the art will recognize that tearing lines may be replaced with one or more granulators for cutting material and opening fibers. Also, steam can be added at any point in the tearing line or prior to air lofting. Additionally, many equivalent classes of enzymes can be utilized to hydrolyze starches or alter surface properties of fibers. The enzyme process also can be added prior to or subsequent to the step of adding steam. Other chemical reagents for removing surface impurities may be substituted for the application of enzymes.

Therefore, persons of ordinary skill in this field are to understand that all such equivalent arrangements and modifications are to be included within the scope if the following claims.

What is claimed is:

1. A cross-lapped hydroentangled material made by the process comprising:

cutting fabric soap material including cotton denim waste to a desired size;

conveying the cut material through a series of rotary pin cylinders for successively cutting the material to form a first web of constituent fibers; each cylinder comprising a plurality of cutting pins disposed about a circumference of said cylinder, such that a cutting angle of the pins of each cylinder can be varied independently to increase or decrease cutting action depending upon the strength and thickness of the fibers, whereby successive cutting action of the cylinders opens the fibers;

applying steam and enzymes at a temperature and rate sufficient to further open and cleanse the fibers of surface additives and bacteria, yet not saturate the web, such that unopened fibers are kept to a range of less than 10%;

forcing said opened and cleaned fibers through a web-laying machine at a desired angle to produce a second web of fibers characterized by substantially unidirectional fiber orientation and uniform fiber density hydroentangling or needle punching the web of unidirectional fibers to produce a hydroentangled material capable of being cross lapped to provide greatly increased strength and absorbency.

2. A hydroentangled product made according to claim 1 further comprising: laminating and coating the resulting hydroentangled material with a polyurethane laminate barrier, for providing a barrier to blood-borne pathogens.

3. A hydroentangled material made according to the process of claim 1 further comprising providing three or more independently controlled cutting pin cylinders C1, C2, Cn for successively opening the scrap fibers, wherein the speed of cylinders C1, C2, Cn, can be varied to obtain different cutting results with respect to different types of fabrics.

4. A needle punched product made according to the process of claim 1 wherein the second web of unidirectionally oriented fibers is conveyed to a needle punching machine.

5. A process for reconstituting fibers from recycled scrap fabric or waste material, including 100 percent cotton denim waste comprising:

conveying the scrap on a conveyor along a direction of travel to a series of Piret cutters;

cutting the material with the Piret cutters to cause a preferential fiber orientation in the lengthwise direction parallel to the direction of travel;

sequentially cutting the preferentially oriented fibers to a desired length in a tearing line using a series of rotary screen cutters, which are arranged orthogonally with respect to the direction of travel, adding steam and enzymes at a sufficient rate and quantity in the tearing line to open, untwist and clean fibers without breaking;

cutting the opened, untwisted fibers substantially across their diameter in a second tearing line;

forming a web of substantially uniform density comprising the opened fibers; and hydroentangling the web to provide a hydroentangled product characterized by uniform structure and consistent disbursement of fibers.

* * * * *